US006465722B2

(12) United States Patent
Powers

(10) Patent No.: US 6,465,722 B2
(45) Date of Patent: Oct. 15, 2002

(54) BRIDGE FOR A MUSICAL INSTRUMENT

(75) Inventor: Michael V. Powers, Meridian, MS (US)

(73) Assignee: Peavey Electronics Corporation, Meridian, MS (US)

( * ) Notice: Subject to any disclaimer, the term of this patent is extended or adjusted under 35 U.S.C. 154(b) by 0 days.

(21) Appl. No.: 09/855,803

(22) Filed: May 16, 2001

(65) Prior Publication Data

US 2002/0000152 A1 Jan. 3, 2002

Related U.S. Application Data

(60) Provisional application No. 60/214,803, filed on Jun. 28, 2000.

(51) Int. Cl.[7] ..... G10D 3/04

(52) U.S. Cl. ..... 84/298; 84/307; 84/312 R; 84/299

(58) Field of Search ..... 84/298, 307, 299, 84/312 R, 297 R

(56) References Cited

U.S. PATENT DOCUMENTS

| | | | | | |
|---|---|---|---|---|---|
| 3,896,695 | A | | 7/1975 | Kingsbury | 84/307 |
| 4,230,014 | A | | 10/1980 | Hoshino | 84/299 |
| 4,433,605 | A | | 2/1984 | Matsui | 84/299 |
| 4,807,508 | A | | 2/1989 | Yairi | 84/297 R |
| 4,840,103 | A | | 6/1989 | Mayer | 84/297 R |
| 5,140,884 | A | * | 8/1992 | Bowden | 84/312 R |
| 5,173,565 | A | * | 12/1992 | Gunn | 84/298 |
| 5,208,410 | A | * | 5/1993 | Foley | 84/307 |
| 5,477,764 | A | | 12/1995 | Carrico | 84/297 R |
| 5,686,677 | A | | 11/1997 | Herbert | 84/307 |
| 5,939,653 | A | * | 8/1999 | Chang | 84/313 |
| 6,124,536 | A | | 9/2000 | Hoshino | 84/298 |
| 6,133,515 | A | * | 10/2000 | Hoshino | 84/307 |

FOREIGN PATENT DOCUMENTS

| | | | |
|---|---|---|---|
| DE | 4019383 | * | 1/1991 |

* cited by examiner

*Primary Examiner*—Shih-Yung Hsieh
(74) *Attorney, Agent, or Firm*—Dykema Gossett PLLC

(57) ABSTRACT

A bridge for attaching strings to a musical instrument. The bridge has a body comprised of a base and a main portion with saddle chambers formed in the main portion. Holes are formed within the saddle chambers. Each saddle chamber houses a saddle members therein. The saddle members have adjusting elements that both adjust the position of the string by changing the position of the saddle member, and adjust the position of the string on the saddle member. A plurality of coupling screws secure the bridge to the body of the instrument. Strings are threaded over the saddle member, through the bridge and out through the compression screws where they are secured or knotted.

13 Claims, 2 Drawing Sheets

BRIDGE FOR A MUSICAL INSTRUMENT

CROSS-REFERENCE TO RELATED APPLICATIONS

This application claims priority to a provisional patent application to Michael Powers, Ser. No. 60/214,803, filed on Jun. 28, 2000, and is currently pending.

BACKGROUND OF THE INVENTION

This invention relates to an apparatus for connecting strings to a musical instrument and more particularly to a bridge that is attached to the body of an instrument which connects and holds strings securely thereto.

Strings are usually attached to a musical instrument at two places: the neck of the instrument and the body of the instrument. There are many different ways for attaching strings to instruments such as a bridge that is screwed or glued directly on top of the body of the instrument. The bridge separates the strings from surfaces of the instrument yet holds the strings in place to the body thereof through a series of holes that the strings pass through where they are then connected to the body of the instrument.

One common type of bridge that exists in the art is illustrated in U.S. Pat. No. 6,124,536 issued to Hoshina entitled "Bridge Mechanism for the Acoustic Guitar." The Hoshina device is comprised of a plurality of individual guitar bridge elements that are attached to a base plate and the base plate is attached to an installation plate. The installation plate is attached directly to the face of the guitar. The bridge members are arranged individually and independently for each guitar string. Each member has a string holder and is adjusted by a plurality of adjusting screws.

Another type of device current in the art is illustrated in a patent issued to Carrico entitled "Quick Attachment Mechanism For Guitar Strings" (U.S. Pat. No. 5,477,764). The Carrico patent discloses another type of string attachment mechanism comprised of two attachment cylinders that fit matingly one inside the other. The first cylinder is frictionally engaged with the guitar bridge. A string is threaded through the second cylinder which then fits within the first cylinder and is locked into place. When the second cylinder is placed within the first cylinder, the string is frictionally locked in place within the first cylinder and the second cylinder.

While there are many ways of attaching strings to the face of an instrument, most consist of attaching the bridge directly to the instrument through screws, glue and the like. In most of the commonly known methods, the bridge is subject to the pressures of the strings pulling the bridge forward toward the neck of the instrument and away from the face of the instrument to which it is attached thus eventually causing the bridge to separate from the instrument completely. Most bridge elements are not adjustable thereby causing all adjustments to the strings to be carried out at the neck region of the instrument.

The present invention is screwed directly onto the top of the guitar body and has a plurality of saddle elements that provide a mechanism for each string to be individually adjusted both in height and length at the body end of the instrument.

SUMMARY OF THE INVENTION

It is an object of the present invention to provide a mechanism for attaching strings to an instrument that allows for fine adjustments of the strings and thereby expanding the instruments performance capabilities.

These means are accomplished by a bridge having a body, a connecting means for connecting the body to the instrument, at least a plurality of slots formed in the body, a plurality of holes formed in the body and located within each of the plurality of slots, holes for receiving the strings, a plurality of adjustable members attached to the body wherein the adjustable members allow for fine adjustments of the height and length of the strings individually.

Other objects, advantages and novel features of the invention will become more apparent from the following detailed description of the invention when taken in conjunction with the accompanying drawings.

DETAILED DESCRIPTION OF THE INVENTION

Figure 1:
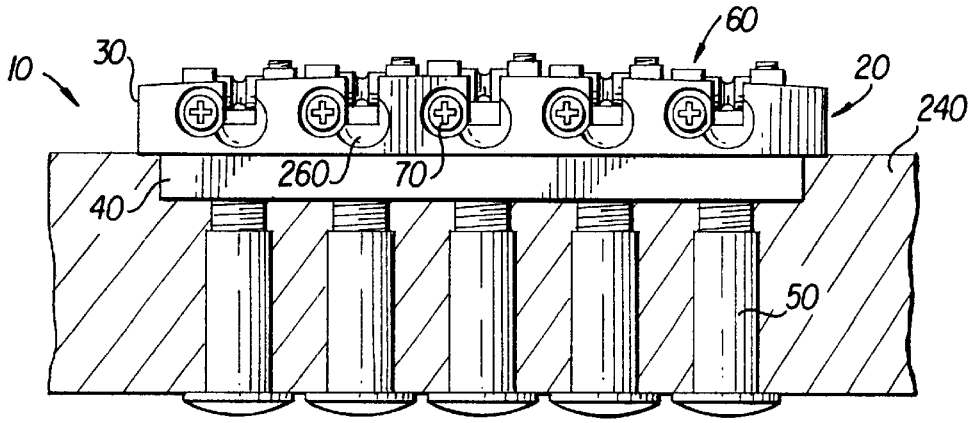
FIG. 1 is a front elevational view of the bridge of the present invention.

The bridge 10 of the present invention has a body 20 that is comprised of a main portion 30 and a base portion 40. The body 20 is substantially rectangular in shape and the base portion 40 is positioned within the body of the instrument 240 when in use.

Figure 2:
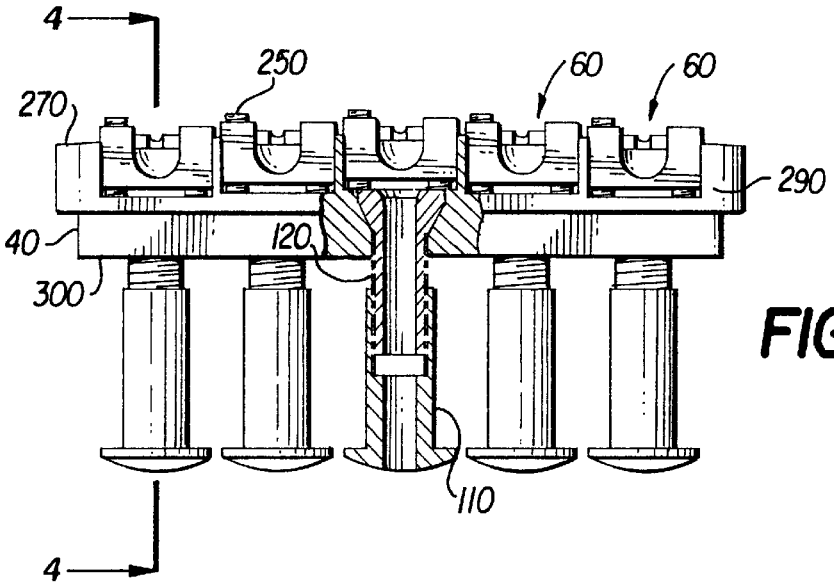
FIG. 2 is a rear elevational view, with a portion broken-away to illustrate the coupling screw.

As illustrated in FIGS. 1 and 2, the body 20 is attached to an instrument body 240 with a plurality of coupling screws 50.

The bridge body 20 has a top surface 270, a side wall 290, and a bottom surface 300. The side wall 290 extends around the entire perimeter of the body 20. A plurality apertures 260 are formed in at least one portion of the side wall 290 and facilitate access to a plurality of adjusting screws 70 that are connected to the bridge 10 and slightly offset from the apertures 260.

Figure 3:
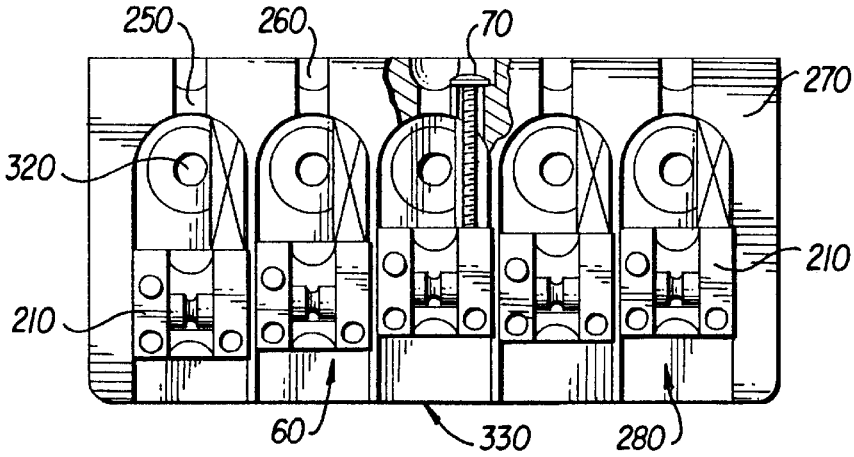
FIG. 3 is a top plan view, with a portion broken-away to illustrate the adjusting screw.

As illustrated in FIG. 3, a plurality of saddle chambers 280 are formed in the top surface 270 of the bridge 10 and extend out through the front 330 of the bridge 10. Adjustable saddle members 60 are attached to the bridge 10 within each saddle chamber 280. Each bridge member 10 is connected to the instrument 240 through coupling screws 50.

The coupling screws are comprised of two parts: an inner portion 120 and an outer portion 110. The inner portion 120 is located partially within the bridge 10.

Each saddle member 60 has an adjustment screw 70 positioned adjacent and attached thereto. This adjustment screw 70 allows for fine adjustments to be made to the length of the string as well as the height of the string. The saddle members 60 can be moved back and forth relative to the front 330 of the bridge 10 thereby adjusting the length of the string.

The adjusting screw 70 is located adjacent aperture 260 and within the side wall 290 of the bridge 10. While the aperture 260 is formed in the side wall 290, a channel 250 extends from the aperture to the saddle chamber 280.

The aperture 260 allows easy access to the head of the adjusting screw 70 and it also allows for the screw to be nestled within the side wall 290 of the bridge 10 so as to prevent it from protruding away from the bridge 10.

Figure 4:
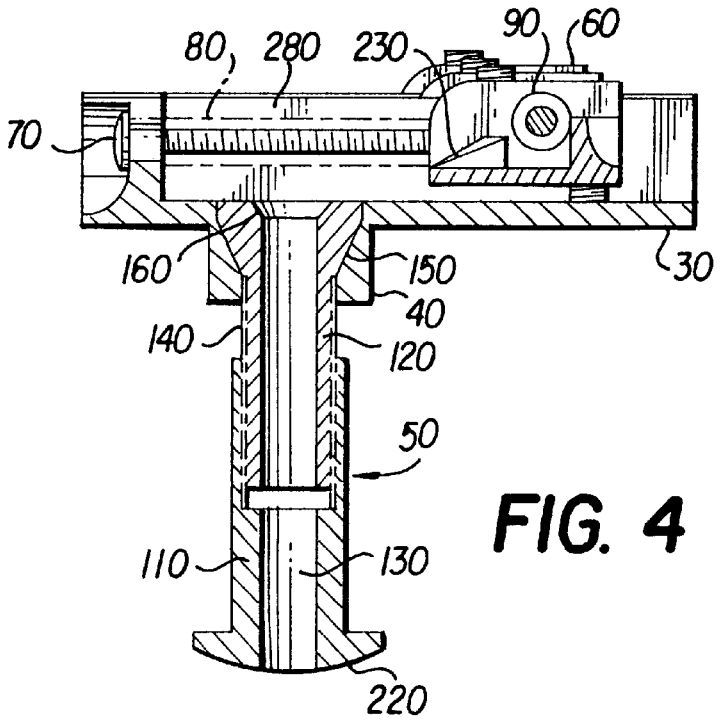
FIG. 4 is a cross-sectional view of the bridge taken along line 4—4 in FIG. 2.

FIG. 4 illustrates that each coupling screw 50 is comprised of two elements: an outer portion 110 and an inner portion 120. Both elements have a central shaft 130 extending therein and through which the string is ultimately be threaded. The inner portion 120 of the coupling screw 50 has at one end a flared interior head 150 at the end located within the bridge 10. This interior head 150 provides support for the coupling screw 50 and surrounds a hole 320 formed in the saddle chamber 280 (shown in FIG. 3). The hole 320 and the shaft 130 are in alignment thereby forming an opening completely through both the bridge 10 and the coupling screws 50.

At the top portion of the inner portion 110 of the coupling screw 50 is an increased end portion 160 that is a graduated opening. This opening allows easy insertion of the string as it passes over the saddle member 60 and is inserted through the instrument body 240 wherein it exits the coupling screw 50 through the opposite end or the exterior head 220 thereof.

The adjusting screw 70 is attached at one end to the saddle member 60 and at the opposite end to the main portion 40 of the bridge 10. A spring 80 is located around the adjusting screw 70 and within the saddle chamber 280 between the two points of attachment to the screw 70. This spring provides tension between the adjusting screw 70 and the saddle member 60 thereby allowing for more fine tuning adjustment of the saddle member 60 via the adjusting screw 70.

Figure 5:
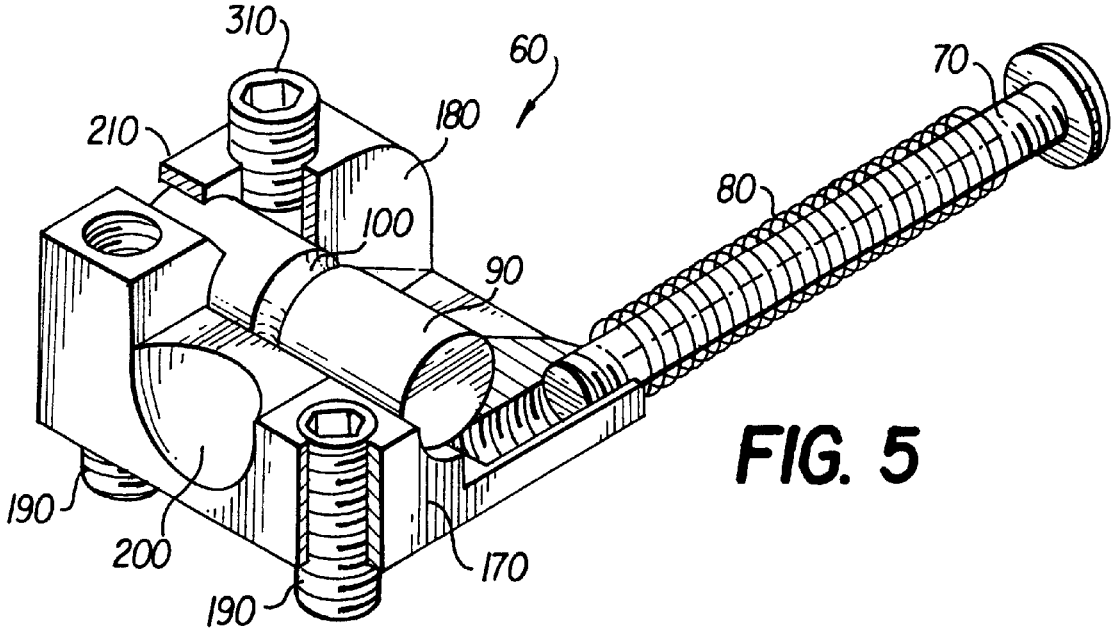
FIG. 5 is a perspective view of the saddle element of the bridge of the present invention.

FIG. 5 illustrates the saddle member 60 in greater detail. The adjustable saddle member 60 is comprised of a lower platform 170 and an upper platform 180 integrally formed therewith. Each saddle member 60 also has a plurality of saddle positioning screws 190 that allow for the platforms 170 and 180 to be raised and lowered with regard to the bridge element 10. Each saddle member 60 also has a cradle adjusting screw 310 that allows for a cradle 90 to be adjusted from a side to side position. The saddle adjusting screw 70 which is inserted through spring 80 is also connected to the saddle 60 and provides for its movement in a for and aft position relative to the front 330 of the bridge 10.

String cradle 90 has a string channel 100 located in its center area and it provides a support for the strings. When in use, a string is threaded through the bridge 10 and comes to rest in the string channel 100. The string also passes over a beveled edge 200 a s it enters the increased end portion the graduated opening 160 of the coupling screw 50 and protrudes out through the opposite end or the head 220 of the coupling screw 50 where it is knotted or secured to a device to hold it therein.

The upper platform 180 retains the cradle adjusting screw 310 therein and also provides retaining elements 210 that extends over the end portions of the string cradle 90 retaining it in position.

The saddle positioning screws 190 allow for the saddle member 60 to be raised and lowered relative to the bridge 10. The cradle adjusting screw 310 allows for the string cradle 90 to be adjusted, and the adjusting screw 70 allows for the saddle member 60 to be adjusted. All of these of adjustment elements thereby contribute to the fine tuning of both the height, length and positioning of the string on the instrument thus providing for peak performance of each string.

In use, the strings (not shown) are threaded through the body of the instrument 240 through the coupling screws 50 and hole 320. This arrangement provides for the bridge 10 to be coupled to the instrument with compression from both the strings as well as from the coupling screws 50. The strings lay over the string cradle 90 through the string channel 100 and are passed through the hole 320 into the central shaft 130 of the coupling screw 50. The strings are attached at the opposite end to the neck of the instrument. When the strings are strummed or plucked, they vibrate causing the bridge 10 to vibrate. This also causes the saddle chambers 280 to act as a resonance chamber for the bridge 10 which allows for vibrations to transfer from the strings to the body of the guitar 240.

Therefore, a method of adjusting strings on a stringed instrument 240 would encompass the step of providing a bridge 10 having a body 20, a plurality of adjustable saddle members 60 attached to the body 20, a plurality of holes 320 formed in the body 20 and a plurality of hollow coupling screws 50 for securing the body 20 to the instrument 240.

The next step is to attach the bridge 10 to the instrument 240 with the coupling screws 50 and then to thread the strings over the saddle members 60, through the bridge 10 and the plurality of coupling screws 50 until it exits the instrument 240 on the opposite side from the bridge 10.

The strings are then secured to neck end of the instrument and the saddle members 60 are adjusted until the strings are in the desired position and location. This allows for the strings to be finely tuned by the player of the instrument 240.

Although the particular embodiments of the invention have been described in detail herein with reference to the accompanying drawings, it is to be understood that the invention is not limited to those precise embodiments and that various changes and modifications may be affected therein by one skilled in the art without departing from the scope or the spirit of the invention as defined in the appended claims.

What is claimed is:

1. A bridge for securing strings to a musical instrument, comprising:

a body having a top surface;

a plurality of saddle chambers formed in said body;

a plurality of saddle members located within said saddle chambers, each saddle member having an adjustable string cradle having an axis of rotation substantially parallel to said top surface;

adjusting means for adjusting said saddle members; and a plurality of holes formed in said body substantially orthogonal to said top surface and located within said plurality of saddle chambers, said holes for receiving the strings, wherein strings are capable of being attached to the musical instrument with said bridge and the bridge is capable of finely adjusting the strings allowing for the performance capabilities to be adjustable.

2. A bridge for securing strings to a musical instrument, comprising:

a body;

a plurality of saddle chambers formed in said body;

a plurality of saddle members located within said saddle chambers, each saddle member having an adjustable string cradle;

adjusting means for adjusting said saddle members;

a plurality of holes formed in said body and located within said plurality of saddle chambers, said holes for receiving the strings; and a plurality of coupling screws for connecting said bridge to the musical instrument, each of said plurality of coupling screws is threaded through the instrument and each said coupling screw is adjacent a single one of said plurality of holes within said body forming an opening through said bridge and the musical instrument, wherein strings are capable of being attached to the musical instrument with said bridge and the bridge is capable of finely adjusting the strings allowing for the performance capabilities to be adjustable, and wherein the strings are threaded through said bridge and said plurality of coupling screws.

3. A bridge for attaching strings to an instrument, comprising: a body;

a plurality of saddle members attached to said body;

a plurality of holes formed in said body;

a plurality of hollow coupling screws for securing said body to the instrument, wherein strings are capable of being threaded through said bridge and said plurality of coupling screws, and said strings are capable of being adjusted by said saddle members.

4. The bridge according to claim 3, wherein: said body further comprises a base and a main portion.

5. The bridge according to claim 4, further comprising:

a plurality of saddle chambers are formed in said main portion of said body.

6. The bridge according to claim 5, wherein:

said plurality of holes are located within said plurality of saddle chambers.

7. The bridge according to claim 6, wherein:

said plurality of saddle members are located within said plurality of saddle chambers.

8. A bridge for securing strings to a musical instrument, comprising:

a body having a top surface;

a plurality of saddle chambers formed in said body, each said saddle chamber having an aperture, substantially orthogonal to said top surface, formed therein for receiving the strings;

a plurality of attachment means for attaching said bridge to the instrument; and a plurality of saddle members attached to said bridge within said plurality of saddle chambers, and each saddle member having at least one adjustable string cradle having an axis of rotation substantially parallel to said top surface, wherein said bridge allows for strings to be attached to the instrument, and said bridge is adjustable thereby allowing for the strings of the instrument to be adjusted for peak performance capabilities.

9. The bridge according to claim 8, wherein:

said body further comprises a main portion and a base portion, wherein said base portion is located partially within the body of the instrument when in use.

10. The bridge according to claim 9, wherein:

said saddle members each have a plurality of adjusting screws for adjusting said saddle member, a string cradle with a string channel formed therein for receiving a string, and at least one cradle adjusting screw for adjusting said string cradle, wherein said saddle is adjustable through said adjusting screws and said saddle adjusting screw so as to finely adjust the string held therewith.

11. The bridge according to claim 10, wherein:

said attachment means is comprised of said plurality of holes and a plurality of coupling screws matingly attached to said body adjacent said plurality of holes, wherein said coupling screws are inserted through the guitar and screwed into a portion of said holes thereby attaching said guitar bridge to the guitar.

12. A bridge for securing strings to a musical instrument, comprising:

a body having a top surface;

connecting means for connecting said bridge to the musical instrument and receiving the strings therethrough;

a plurality of saddle chambers formed in said body;

a plurality of saddle members located within said saddle chambers, each saddle member having an adjustable string cradle having an axis of rotation substantially parallel to said top surface;

adjusting means for adjusting said saddle members; and a plurality of holes formed in said body substantially orthogonal to said top surface and located within said plurality of saddle chambers, said holes for receiving the strings, wherein strings are attached to the musical instrument with said bridge and the bridge is capable of finely adjusting the strings allowing for the performance capabilities to be adjustable.

13. A method of adjusting strings on a stringed instrument, comprising the steps of:

providing a bridge having a body;

a plurality of adjustable saddle members attached to said body;

a plurality of holes formed in said body;

a plurality of hollow coupling screws for securing said body to the instrument;

attaching said bridge to the instrument with said plurality of coupling screws;

threading one end of each of the strings over a saddle member of said plurality of saddle members, through said bridge and said plurality of coupling screws, and securing the strings to said bridge;

securing the opposite end of the string to the opposite end of the instrument; and adjusting said saddle members thereby adjusting the strings.

* * * * *